US009490546B2

(12) United States Patent
Yoshino et al.

(10) Patent No.: US 9,490,546 B2
(45) Date of Patent: Nov. 8, 2016

(54) ANTENNA

(71) Applicant: Sony Corporation, Tokyo (JP)

(72) Inventors: Yoshitaka Yoshino, Tokyo (JP); Tomomichi Murakami, Tokyo (JP); Satoru Tsuboi, Kanagawa (JP)

(73) Assignee: Sony Corporation, Tokyo (JP)

( * ) Notice: Subject to any disclaimer, the term of this patent is extended or adjusted under 35 U.S.C. 154(b) by 22 days.

(21) Appl. No.: 14/413,116

(22) PCT Filed: Jul. 3, 2013

(86) PCT No.: PCT/JP2013/068225

§ 371 (c)(1),
(2) Date: Jan. 6, 2015

(87) PCT Pub. No.: WO2014/010481

PCT Pub. Date: Jan. 16, 2014

(65) Prior Publication Data

US 2015/0200464 A1 Jul. 16, 2015

(30) Foreign Application Priority Data

Jul. 13, 2012 (JP) ..... 2012-157408

(51) Int. Cl.
*H01Q 1/52* (2006.01)
*H01Q 17/00* (2006.01)
*H01Q 1/46* (2006.01)

(52) U.S. Cl.
CPC ..... *H01Q 17/004* (2013.01); *H01Q 1/46* (2013.01); *H01Q 1/52* (2013.01); *H01Q 17/00* (2013.01)

(58) Field of Classification Search
CPC ..... H01Q 1/52; H01Q 1/46; H01Q 17/004; H01Q 17/00
USPC ..... 343/841, 791
See application file for complete search history.

(56) References Cited

U.S. PATENT DOCUMENTS

| | | | | |
|---|---|---|---|---|
| 7,539,510 | B2 * | 5/2009 | Toyoda | H01Q 1/245 343/702 |
| 8,487,827 | B2 | 7/2013 | Mukai et al. | |
| 8,780,011 | B2 | 7/2014 | Yoshino et al. | |
| 2007/0171134 | A1 | 7/2007 | Yoshino et al. | |
| 2008/0111749 | A1 * | 5/2008 | Nam | H01Q 9/0407 343/702 |
| 2010/0238088 | A1 | 9/2010 | Mukai et al. | |
| 2010/0245185 | A1 | 9/2010 | Mukai et al. | |
| 2012/0050133 | A1 | 3/2012 | Yoshino et al. | |
| 2013/0009835 | A1 | 1/2013 | Yoshino et al. | |
| 2014/0333493 | A1 | 11/2014 | Yoshino et al. | |
| 2015/0055020 | A1 | 2/2015 | Yoshino et al. | |

FOREIGN PATENT DOCUMENTS

| | | | |
|---|---|---|---|
| JP | 58-3606 | U | 1/1983 |
| JP | 10-031913 | A | 2/1998 |
| JP | 2002-151932 | A | 5/2002 |
| JP | 2004-111178 | A | 4/2004 |
| JP | 2004-274356 | A | 9/2004 |
| JP | 2009-224075 | A | 10/2009 |
| JP | 2011-172125 | A | 9/2011 |
| JP | 2011-199651 | A | 10/2011 |

* cited by examiner

*Primary Examiner* — Dieu H Duong
(74) *Attorney, Agent, or Firm* — Wolf, Greenfield & Sacks, P.C.

(57) ABSTRACT

There is provided an antenna including an antenna element that has a prescribed length and detects a line of electric force, a transmission line that transmits an electrical signal, and a radio wave absorbing and attenuating part that has characteristics to absorb and attenuate a radio wave of a frequency band received by the antenna element and is arranged at least between the antenna element and the transmission line.

7 Claims, 14 Drawing Sheets

FIG.5
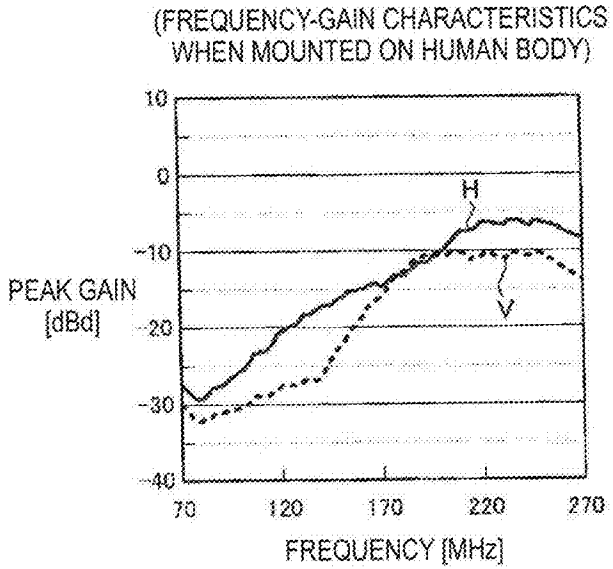
D
| | VERTICALLY POLARIZED WAVE | | | | | | | |
|---|---|---|---|---|---|---|---|---|
| FREQUENCY [MHz] | 188.5 | 192.5 | 194.5 | 198 | 204 | 210 | 216 | 222 |
| PEAK[dBd] | -11.24 | -10.90 | -10.93 | -10.83 | -10.67 | -10.44 | -11.22 | -10.59 |
E
| | HORIZONTALLY POLARIZED WAVE | | | | | | | |
|---|---|---|---|---|---|---|---|---|
| FREQUENCY [MHz] | 188.5 | 192.5 | 194.5 | 198 | 204 | 210 | 216 | 222 |
| PEAK[dBd] | -11.89 | -11.47 | -11.17 | -10.40 | -9.27 | -7.75 | -7.43 | -9.46 |
F
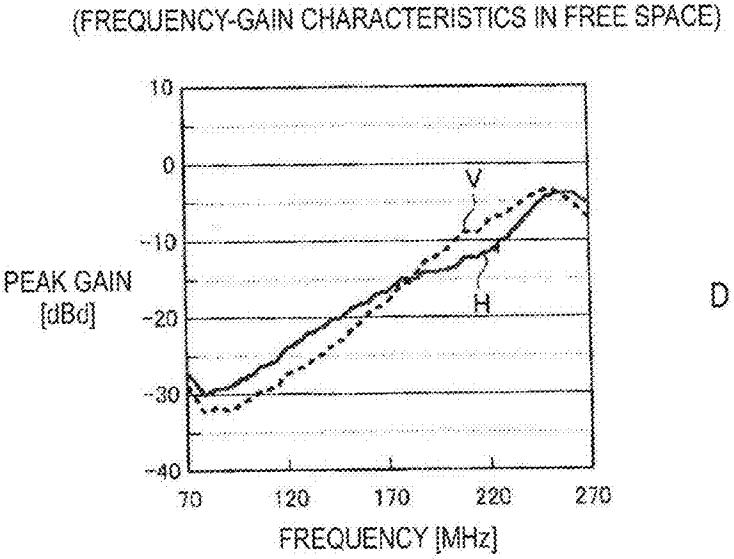
A
| | VERTICALLY POLARIZED WAVE | | | | | | | |
|---|---|---|---|---|---|---|---|---|
| FREQUENCY [MHz] | 188.5 | 192.5 | 194.5 | 198 | 204 | 210 | 216 | 222 |
| PEAK[dBd] | -13.29 | -12.67 | -12.25 | -11.60 | -10.31 | -8.99 | -9.01 | -7.39 |
B
| | HORIZONTALLY POLARIZED WAVE | | | | | | | |
|---|---|---|---|---|---|---|---|---|
| FREQUENCY [MHz] | 188.5 | 192.5 | 194.5 | 198 | 204 | 210 | 216 | 222 |
| PEAK[dBd] | -14.29 | -14.27 | -14.25 | -14.03 | -13.67 | -12.36 | -12.27 | -11.30 |
C

A

| | VERTICALLY POLARIZED WAVE | | | | | | | |
|---|---|---|---|---|---|---|---|---|
| FREQUENCY [MHz] | 188.5 | 192.5 | 194.5 | 198 | 204 | 210 | 216 | 222 |
| PEAK[dBd] | -10.69 | -10.64 | -10.73 | -10.83 | -10.07 | -9.28 | -9.63 | -8.14 |

B

| | HORIZONTALLY POLARIZED WAVE | | | | | | | |
|---|---|---|---|---|---|---|---|---|
| FREQUENCY [MHz] | 188.5 | 192.5 | 194.5 | 198 | 204 | 210 | 216 | 222 |
| PEAK[dBd] | -19.44 | -19.27 | -19.20 | -18.89 | -17.47 | -15.66 | -15.38 | -10.70 |

C

D

| | VERTICALLY POLARIZED WAVE | | | | | | | |
|---|---|---|---|---|---|---|---|---|
| FREQUENCY [MHz] | 188.5 | 192.5 | 194.5 | 198 | 204 | 210 | 216 | 222 |
| PEAK[dBd] | -12.49 | -12.07 | -12.88 | -11.83 | -11.27 | -11.04 | -11.83 | -11.59 |

E

| | HORIZONTALLY POLARIZED WAVE | | | | | | | |
|---|---|---|---|---|---|---|---|---|
| FREQUENCY [MHz] | 188.5 | 192.5 | 194.5 | 198 | 204 | 210 | 216 | 222 |
| PEAK[dBd] | -13.14 | -12.59 | -12.08 | -11.38 | -9.91 | -9.35 | -8.21 | -7.46 |

F

A

B

| | VERTICALLY POLARIZED WAVE | | | | | | | |
|---|---|---|---|---|---|---|---|---|
| FREQUENCY [MHz] | 188.5 | 192.5 | 194.5 | 198 | 204 | 210 | 216 | 222 |
| PEAK[dBd] | -9.44 | -9.67 | -9.93 | -9.83 | -9.63 | -8.95 | -9.43 | -7.94 |

C

| | HORIZONTALLY POLARIZED WAVE | | | | | | | |
|---|---|---|---|---|---|---|---|---|
| FREQUENCY [MHz] | 188.5 | 192.5 | 194.5 | 198 | 204 | 210 | 216 | 222 |
| PEAK[dBd] | -19.24 | -19.64 | -19.73 | -19.63 | -18.55 | -16.26 | -15.61 | -13.78 |

D

E

| | VERTICALLY POLARIZED WAVE | | | | | | | |
|---|---|---|---|---|---|---|---|---|
| FREQUENCY [MHz] | 188.5 | 192.5 | 194.5 | 198 | 204 | 210 | 216 | 222 |
| PEAK[dBd] | -11.09 | -10.67 | -10.93 | -10.83 | -10.63 | -10.15 | -10.83 | -10.30 |

F

| | HORIZONTALLY POLARIZED WAVE | | | | | | | |
|---|---|---|---|---|---|---|---|---|
| FREQUENCY [MHz] | 188.5 | 192.5 | 194.5 | 198 | 204 | 210 | 216 | 222 |
| PEAK[dBd] | -13.29 | -12.50 | -12.17 | -11.28 | -9.71 | -8.15 | -7.81 | -6.90 |

A

B

| | VERTICALLY POLARIZED WAVE | | | | | | | |
|---|---|---|---|---|---|---|---|---|
| FREQUENCY [MHz] | 188.5 | 192.5 | 194.5 | 198 | 204 | 210 | 216 | 222 |
| PEAK[dBd] | -7.49 | -7.27 | -7.33 | -7.43 | -7.23 | -7.24 | -8.05 | -8.28 |

C

| | HORIZONTALLY POLARIZED WAVE | | | | | | | |
|---|---|---|---|---|---|---|---|---|
| FREQUENCY [MHz] | 188.5 | 192.5 | 194.5 | 198 | 204 | 210 | 216 | 222 |
| PEAK[dBd] | -13.94 | -13.10 | -12.85 | -12.20 | -10.51 | -8.86 | -8.18 | -7.06 |

FIG.9
A
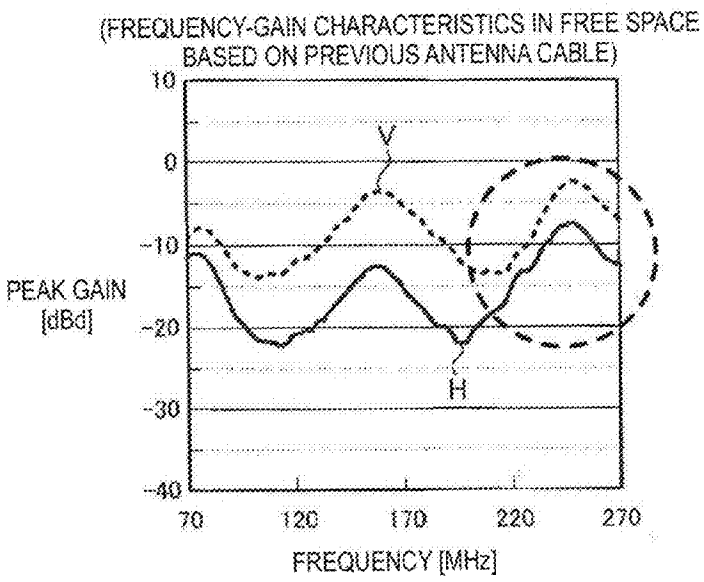
B
| | VERTICALLY POLARIZED WAVE | | | | | | |
|---|---|---|---|---|---|---|---|
| FREQUENCY [MHz] | 188.5 | 192.5 | 194.5 | 198 | 204 | 210 | 216 | 222 |
| PEAK[dBd] | -9.58 | -10.76 | -11.48 | -12.45 | -13.54 | -13.35 | -13.63 | -11.54 |
C
| | HORIZONTALLY POLARIZED WAVE | | | | | | | |
|---|---|---|---|---|---|---|---|---|
| FREQUENCY [MHz] | 188.5 | 192.5 | 194.5 | 198 | 204 | 210 | 216 | 222 |
| PEAK[dBd] | -20.04 | -21.20 | -22.06 | -22.63 | -20.27 | -18.56 | -17.56 | -14.50 |
D
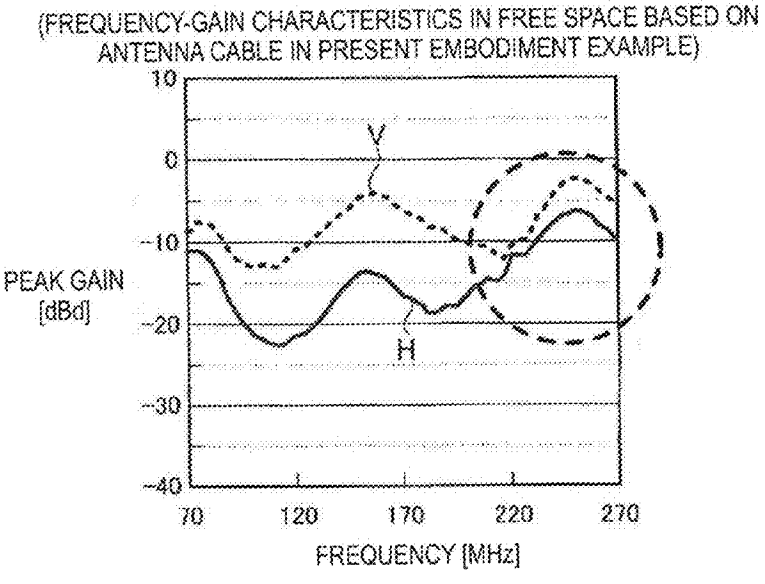
E
| | VERTICALLY POLARIZED WAVE | | | | | | | |
|---|---|---|---|---|---|---|---|---|
| FREQUENCY [MHz] | 188.5 | 192.5 | 194.5 | 198 | 204 | 210 | 216 | 222 |
| PEAK[dBd] | -8.44 | -9.20 | -9.58 | -10.25 | -10.33 | -10.84 | -12.23 | -10.70 |
F
| | HORIZONTALLY POLARIZED WAVE | | | | | | | |
|---|---|---|---|---|---|---|---|---|
| FREQUENCY [MHz] | 188.5 | 192.5 | 194.5 | 198 | 204 | 210 | 216 | 222 |
| PEAK[dBd] | -18.34 | -18.07 | -18.13 | -17.78 | -16.07 | -14.86 | -14.98 | -11.98 |

FIG.10

A (FREQUENCY-GAIN CHARACTERISTICS BASED ON PREVIOUS ANTENNA CABLE WHEN MOUNTED ON HUMAN BODY)

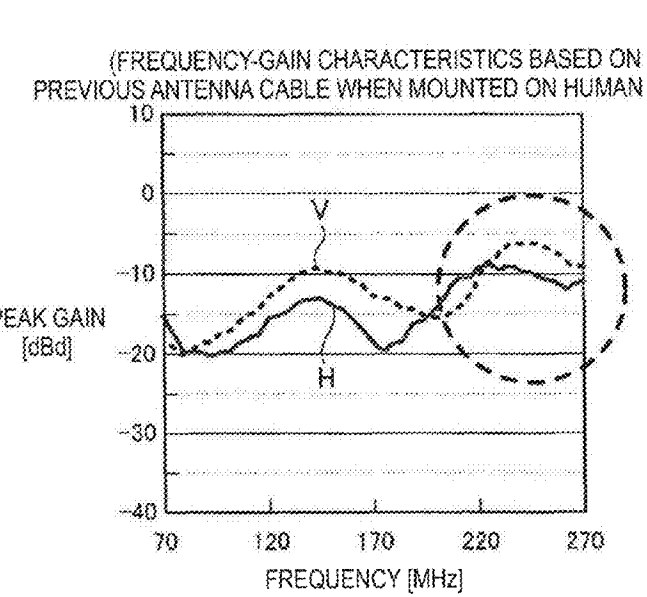

B

| | VERTICALLY POLARIZED WAVE | | | | | | |
|---|---|---|---|---|---|---|---|
| FREQUENCY [MHz] | 188.5 | 192.5 | 194.5 | 198 | 204 | 210 | 216 | 222 |
| PEAK[dBd] | -14.44 | -15.04 | -15.40 | -15.43 | -15.38 | -14.35 | -12.56 | -9.38 |

C

| | HORIZONTALLY POLARIZED WAVE | | | | | | | |
|---|---|---|---|---|---|---|---|---|
| FREQUENCY [MHz] | 188.5 | 192.5 | 194.5 | 198 | 204 | 210 | 216 | 222 |
| PEAK[dBd] | -16.54 | -15.90 | -15.65 | -14.79 | -12.91 | -10.88 | -10.56 | -9.06 |

D (FREQUENCY-GAIN CHARACTERISTICS BASED ON ANTENNA CABLE IN PRESENT EMBODIMENT EXAMPLE WHEN MOUNTED ON HUMAN BODY)

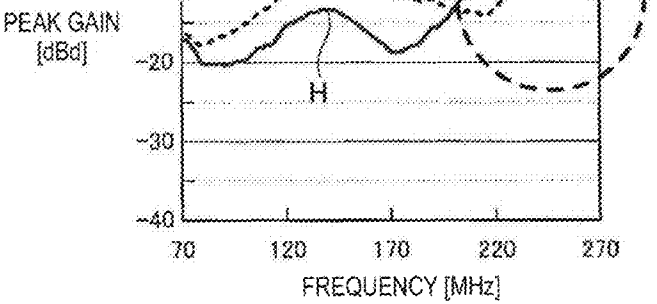

E

| | VERTICALLY POLARIZED WAVE | | | | | | |
|---|---|---|---|---|---|---|---|
| FREQUENCY [MHz] | 188.5 | 192.5 | 194.5 | 198 | 204 | 210 | 216 | 222 |
| PEAK[dBd] | -12.24 | -12.64 | -13.00 | -13.43 | -13.98 | -13.75 | -14.21 | -12.54 |

F

| | HORIZONTALLY POLARIZED WAVE | | | | | | | |
|---|---|---|---|---|---|---|---|---|
| FREQUENCY [MHz] | 188.5 | 192.5 | 194.5 | 198 | 204 | 210 | 216 | 222 |
| PEAK[dBd] | -16.09 | -15.50 | -15.17 | -14.18 | -12.11 | -9.60 | -9.21 | -7.66 |

FIG.12
A
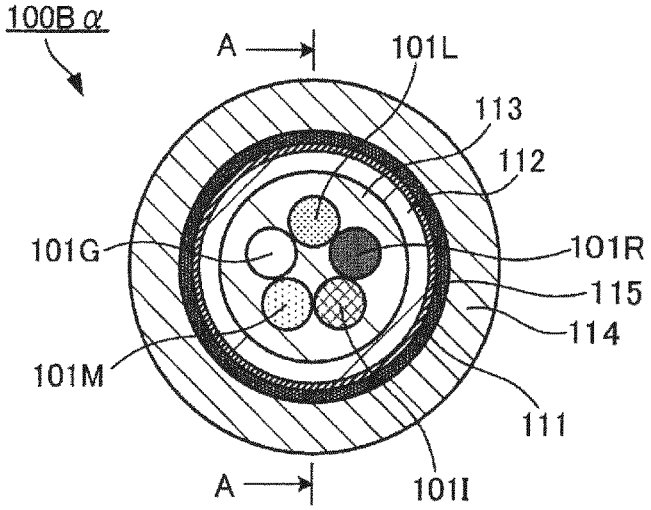
B
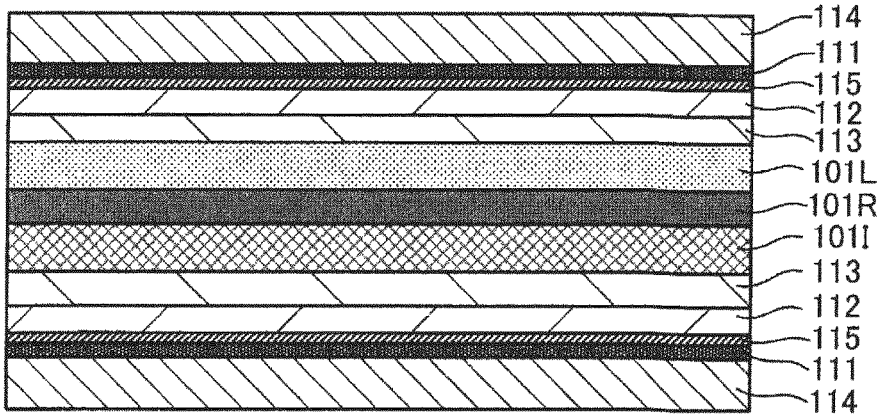

ANTENNA

CROSS REFERENCE TO RELATED APPLICATIONS

The present application is a U.S. National Stage Application under 35 U.S.C. §371, based on International Application No. PCT/JP2013/068225, filed Jul. 3, 2013, which claims priority under 35 U.S.C. §119 to Japanese Patent Application No. JP 2012-157408, filed in the Japan Office on Jul. 13, 2012, the entire contents of each of which is incorporated herein by reference.

TECHNICAL FIELD

The present disclosure relates to an antenna having an antenna element which is used in a state of being arranged close to transmission lines of electrical signals such as an audio signal and a power source, and in particular, relates to a technology to enhance antenna characteristics in such antenna.

BACKGROUND ART

In recent years, it comes to be increased that an antenna element which receives radio waves in digital television broadcasting and digital radio broadcasting, etc. is arranged in a position which is so much close to transmission lines of electrical signals such as an audio signal and a power source. In Patent Literature 1, an antenna cable in which a core wire of a coaxial line is used as transmission lines of an audio signal, and a shield line (outer conductor) of the coaxial line is made to function as the antenna element has been described.

CITATION LIST

Patent Literature

Patent Literature 1: JP 2011-172125A

SUMMARY OF INVENTION

Technical Problem

Incidentally, when two or more of transmission lines are arranged while adjoining to one another as is the case for the antenna cable described in Patent Literature 1, capacitive coupling may be caused while respective electromagnetic fields affect one another. When such capacitive coupling occurs, an electrical signal which propagates on each of transmission lines propagates to other adjacent transmission lines, and a signal to be propagated originally will be attenuated. For example, when an audio signal transmitted in other transmission lines exists in the vicinity of an RF signal transmitted in the antenna element, the RF signal is attenuated, and antenna reception characteristics will be deteriorated. In the technology described in Patent Literature 1, there is a problem that such deterioration of antenna reception characteristics may occur since the capacitive coupling is difficult to be prevented from being generated between transmission lines.

The present disclosure is made in view of such a point, and an object is to enhance antenna characteristics in an antenna having an antenna element used in a state of being arranged close to transmission lines of electrical signals such as an audio signal and a power source.

Solution to Problem

An antenna according to the present disclosure includes an antenna element that has a prescribed length and detects a line of electric force, a transmission line that transmits an electrical signal, and a radio wave absorbing and attenuating part that has characteristics to absorb and attenuate a radio wave of a frequency band received by the antenna element and is arranged at least between the antenna element and the transmission line.

By configuring the antenna in such a way as described above, it becomes possible to suppress generation of the capacitive coupling between the antenna element and transmission lines since the radio wave of the frequency band received by the antenna element is absorbed and attenuated in the radio wave absorbing and attenuating part.

Advantageous Effects of Invention

According to the antenna of the present disclosure, since capacitive coupling becomes difficult to be generated between the antenna element and the transmission lines, the antenna reception characteristics can be kept satisfactory.

BRIEF DESCRIPTION OF DRAWINGS

FIG. 5 illustrates frequency-gain characteristics in a case where a resistor is inserted in a connection section between a cable part and a jack of the antenna cable, in which A to C illustrate frequency-gain characteristics measured in a state where the antenna cable is not mounted on a human body, and D to F illustrate frequency-gain characteristics measured in a state where the antenna cable is mounted on a human body;

FIG. 9 illustrates frequency-gain characteristics measured in a state where an earphone cable 200 having a length of 1100 mm is inserted and not mounted on a human body, according to an embodiment of the present disclosure, in which A to C illustrate frequency-gain characteristics based on a previous antenna cable, and D to F illustrate frequency-gain characteristics based on an antenna cable of the present configuration;

FIG. 10 illustrates frequency-gain characteristics measured in a state where an earphone cable 200 having a length of 1100 mm is inserted and mounted on a human body, according to an embodiment of the present disclosure, in which A to C illustrate frequency-gain characteristics based on a previous antenna cable, and D to F illustrate frequency-gain characteristics based on an antenna cable of the present configuration;

FIG. 12 is schematic diagrams illustrating an example of a schematic configuration of an antenna cable according to a modification example 2 of the present disclosure, in which A illustrates a sectional view in the case of being cut in a diameter direction, and B illustrates a sectional view in the case of being cut in a line length direction;

DESCRIPTION OF EMBODIMENTS

An example of an antenna according to an embodiment of the present disclosure will be described with reference to drawings in the following order. However, the present disclosure is not limited to following examples.

1. A configuration example of an antenna according to an embodiment example of the present disclosure
2. A configuration example of a receiving system to which an antenna according to an embodiment of the present disclosure is applied
3. Various modification examples <1. Configuration Example of Antenna>

Figure 1:
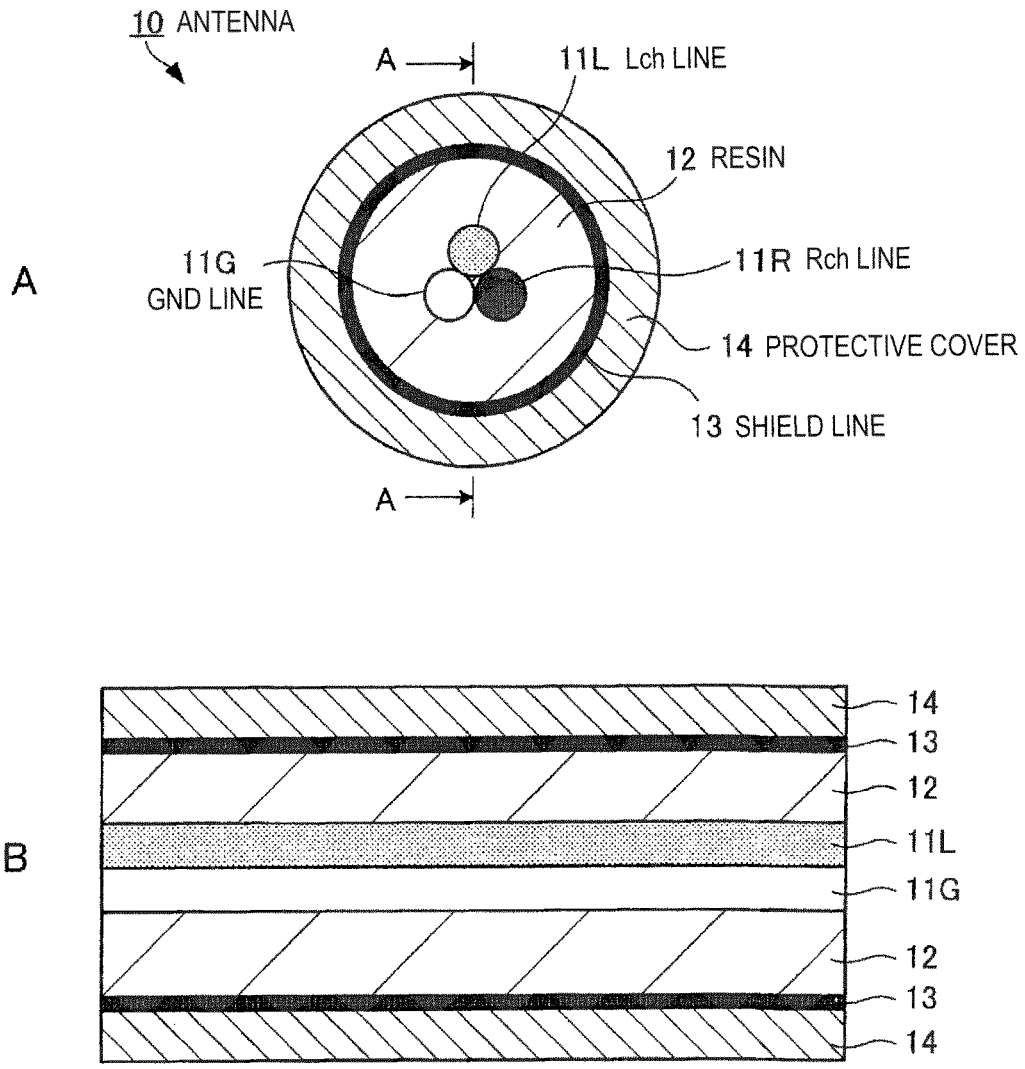
FIG. 1 is schematic diagrams illustrating an example of a schematic configuration of an antenna according to an embodiment of the present disclosure, in which A illustrates a sectional view in a case of being cut in a diameter direction, and B illustrates a sectional view in a case of being cut in a line length direction.

First, with reference to FIGS. 1A and 1B, a configuration example of an antenna 10 to which an antenna according to the present disclosure is applied will be described. FIGS. 1A and 1B are sectional views illustrating an example of an internal configuration of the antenna 10 at the time of forming an antenna of the present disclosure with a coaxial line. FIG. 1A is a sectional view in a case where the antenna 10 formed as the coaxial line is cut in a direction perpendicular to a line length direction, and FIG. 1B is a sectional view in a case where the antenna 10 is cut in a line length direction thereof and viewed from a direction indicated as a cross section indicating line A illustrated in FIG. 1A.

As illustrated in FIGS. 1A and 1B, in a central part of the antenna 10, an Lch line 11L through which a audio signal of an L (left) channel is transmitted, an Rch line 11R through which a voice signal of an R (right) channel is transmitted and a GND (ground) line 11G are provided. These are formed as a core wire (inner conductor) of the coaxial line. In an outer circumferential part of these transmission lines (transmission line) 11, a layer made of a resin 12 is provided.

The resin 12 is formed as a synthetic resin (insulator) with a powder of a magnetic material mixed therein. In the present embodiment, as a magnetic material compounded with a synthetic resin as powder, a ferrite which has radio wave absorption characteristics to absorb and attenuate a radio wave and high impedance characteristics in a high frequency is used. It is configured such that a thickness of the layer made of the resin 12 is uniform over the entire circumference with respect to a cross section in a diameter direction of the antenna 10 constituted as a coaxial line.

In an outer circumferential part of the resin 12, a shield line 13 as an outer conductor is provided, and this shield line 13 functions as an antenna element. Then, the outer circumference of the shield line 13 as the antenna element is covered with a protective cover 14.

The resin 12 as a radio wave absorbing and attenuating part containing a ferrite is provided between the shield line 13 as the antenna element and each transmission line 11, and thus a signal transmitted through each line can be prevented from being leaked to the external space of the transmission line. Thereby, since isolation between each transmission line 11 and the antenna element is ensured, reception characteristics of the antenna 10 are also kept satisfactory.

In order to acquire such effect, it is necessary to set a material, cross-sectional area and magnetic path length of a magnetic material which is made to be compounded with the resin 12 to a value such that a sufficiently large impedance may be acquired in a frequency band which is desired to be received by the antenna element. As a material of the magnetic material, the material in which an imaginary part which is a magnetic loss term of a complex magnetic permeability (μ) is high in a frequency band which is desired to be received by the antenna element is made to be selected.

The complex magnetic permeability μ can be given by the following formula 1.

$$\mu=\mu'-j\mu'' \qquad \text{Formula 1}$$

In the above formula 1, μ' denotes an inductance component in a real part, and μ" denotes a resistance component in an imaginary part. The μ" of the imaginary part which denotes the resistance component can be calculated by the following formula 2.

$$\mu'' = \frac{l_E}{\mu_0 A_E N^2} \times \frac{R_{MSD}}{2\pi f} \qquad \text{formula 2}$$

In the above formula 2, "$A_E$" denotes an effective cross-sectional area (area through which a magnetic flux passes: unit $m^2$) of the magnetic material, and "$l_E$" denotes an effective magnetic path length (distance in which the magnetic flux flows: unit m). In addition, "$\mu_0$" denotes a magnetic permeability in a vacuum, "N" denotes the number of turns of a coil for measurement, "f" denotes a frequency (Hz), and "$R_{MSD}$" denotes measured resistance (Ω).

As indicated in the above formula 2, by changing the effective cross-sectional area $A_E$ and effective magnetic path length $l_E$ of the magnetic material, a value of the imaginary part μ" which is the magnetic loss term of the complex magnetic permeability μ can be changed. In other words, by adjusting these parameters, even when a radio wave of any kind of frequency band is received, it becomes possible to ensure isolation between the antenna element and the transmission line of the other signal.

<2. Configuration Example of Receiving System According to Embodiment Example>

Figure 2:
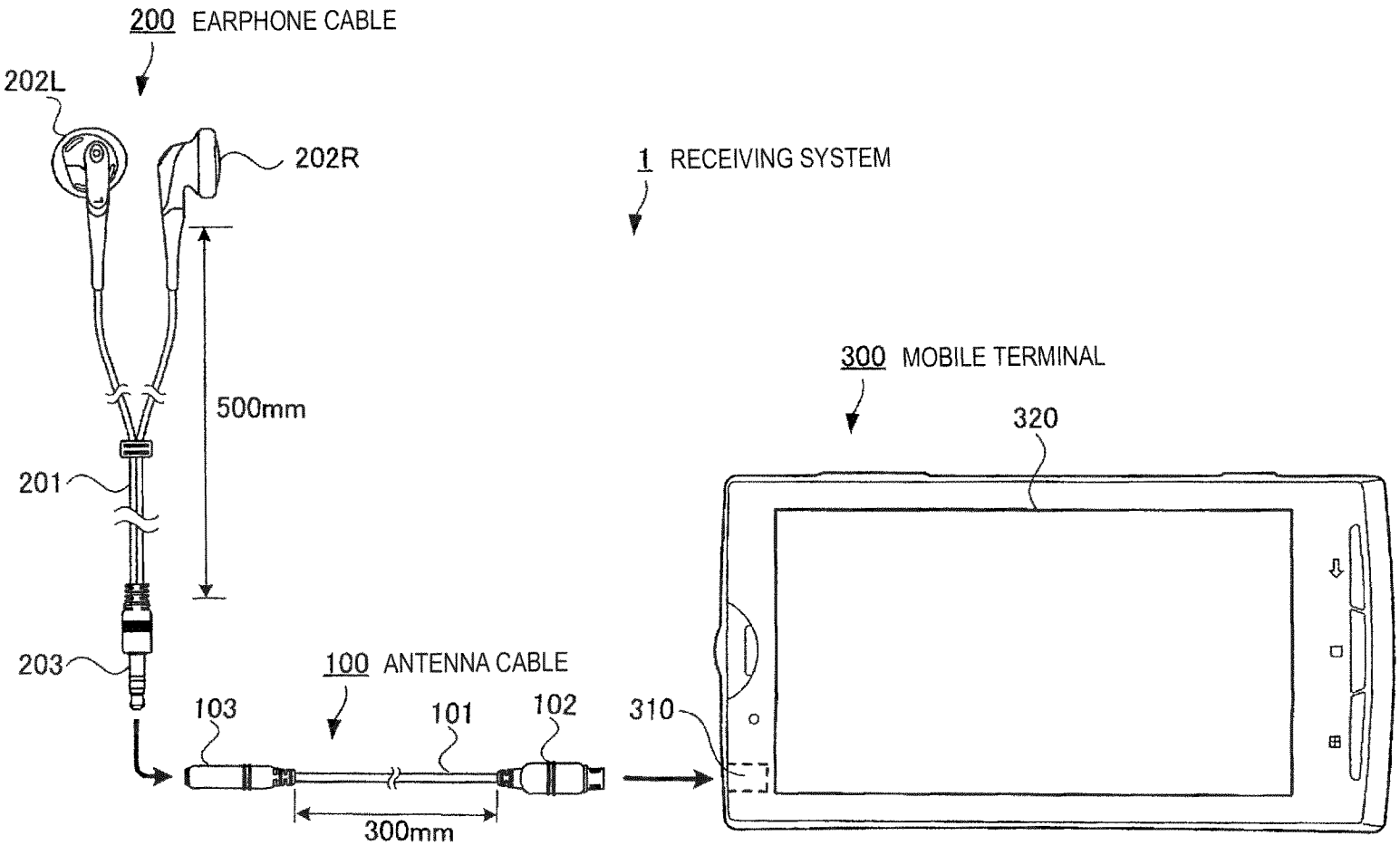
FIG. 2 is a schematic diagram illustrating a configuration example of a receiving system according to an embodiment of the present disclosure.

Next, a configuration example of a receiving system 1 to which an antenna according to a first embodiment example of the present disclosure is applied will be described with reference to FIG. 2. The receiving system 1 includes an antenna cable 100 to which the antenna 10 according to the present disclosure is applied, an earphone cable 200 connected to the antenna cable 100, and a mobile terminal 300 to which the antenna cable 100 is connected.

The antenna cable 100 is inserted in a universal serial bus (μUSB) terminal, and is constituted as a cable having both a function of an audio transmission cable for hearing an audio and a function of an antenna to receive an RF signal. In FIG. 2, a case where a subject of connection is the earphone cable 200 is illustrated, and it is also possible that the earphone cable 200 is used while being connected in this way. The antenna cable 100, when used separately, functions only as an antenna function, and functions in this case while having both the audio transmission function and the antenna function.

The antenna cable 100 includes a cable part 101, a plug 102 provided in one end of the cable part 101 and a jack 103 provided in the other end. The cable part 101 is made to have a coaxial structure in the same way as the structure illustrated in FIGS. 1A and 1B, and includes core wires as various electrical signal transmission lines, and the shield line which functions as the antenna element (illustration is each omitted in FIG. 2). The core wire is formed of an annealed copper wire etc., for example, and the shield line is formed as a braided wire in which the annealed copper wire is braided, for example. Note that, a winding wire may be applied instead of a braid wire.

Between core wires and the shield line, as illustrated in FIGS. 1A and 1B, a layer made of a resin as the radio wave absorbing and attenuating part is provided. Details of an internal configuration of antenna cable 100 will be mentioned later. The outer circumferential part of the shield line is covered with a protective cover made of a resin such as a vinyl chloride resin and an elastomer.

The plug 102 is inserted in a connection terminal 310 provided in the mobile terminal 300, and into the jack 103, a plug 203 of the earphone cable 200 is inserted. In the present embodiment, the plug 102 is configured as a μUSB plug, and the connection terminal 310 in the mobile terminal 300 is configured as a μUSB connection terminal.

When the antenna cable 100 functions as an antenna, the mobile terminal 300 to which the plug 102 is inserted functions as a ground (GND), and a portion of the shield line of the antenna cable 100 functions as a monopole antenna (electric field type antenna). When the earphone cable 200 is inserted in the jack 103, the full length also including a portion of the earphone cable 200 also receives a radio wave as the antenna element.

In the present embodiment, so that frequencies of a VHF-high band (around 200 MHz) which are used in a multimedia broadcasting for mobile terminals may be received with a length of the antenna cable 100 portion, the length of the shield line portion of the antenna cable 100 is adjusted to be 300 mm of λ/4. When the earphone cable 200 of 500 mm is connected to the antenna cable 100, frequencies in a FM band can be received by a total length with both added.

The earphone cable 200 has a cable part 201, and has an earphone 202R for the Rch and an earphone 202L for the Lch which are connected to tip ends of portions branched from the cable part 201, respectively. In addition, in the other end of the cable part 201, the plug 203 configured as a three-pole plug of e.g. 3.5 mmϕ is connected. The plug 203 of the earphone cable 200 is inserted in the jack 103 of the antenna cable 100. In addition, although the earphone cable 200 of FIG. 2 is the earphone which transmits only an audio signal, and there is no problem even in the case of one which has a function of a microphone. In that case, the plug 203 of the cable part 201 is configured as a four-pole plug of 3.5 mmϕ.

The mobile terminal 300 is provided with the connection terminal 310 as described above, and into this connection terminal 310, the plug 102 of the antenna cable 100 is inserted. In addition, the mobile terminal 300 is provided with a tuner part (illustration omitted) which receives digital television broadcasting, digital radio broadcasting and FM broadcasting, and in the tuner part, processing to demodulate and decode these broadcast waves received by the antenna cable 100 and/or the earphone cable 200 is performed. In addition, the mobile terminal 300 is provided with an audio processing circuit which is not illustrated. In the audio processing circuit, decoding processing of audio data demodulated in the tuner part and audio coded data stored in a non-illustrated storage unit is performed, and the decoded audio data are supplied to the earphone 202L for the Lch and the earphone 202R for the Rch and is outputted as an audio. The mobile terminal 300 is provided further with a display part 320 made of a liquid crystal panel or an organic electro luminescence (EL) panel. On the display part 320, video data etc. decoded in the tuner part are displayed.

Figure 3:
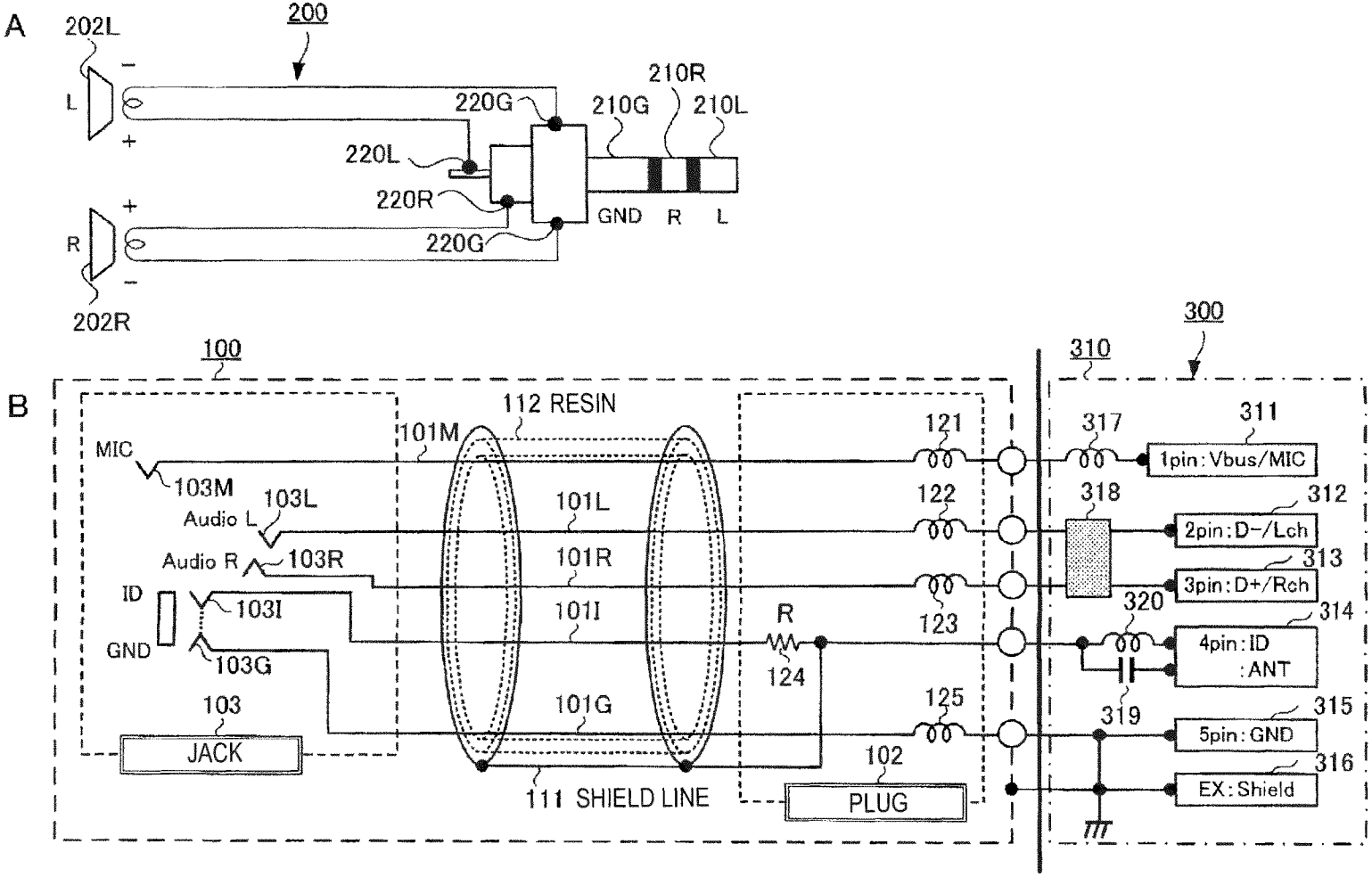
FIG. 3 is circuit diagrams illustrating a configuration example of an earphone cable, an antenna cable and a connection terminal in a mobile terminal according to an embodiment of the present disclosure.

Next, with reference to FIGS. 3A and 3B, an example of an internal configuration of the antenna cable 100 to which the antenna cable 10 of the present disclosure illustrated in FIG. 1A is applied, the earphone cable 200, and the connection terminal 310 of the mobile terminal 300 will be described. In FIG. 3A, an example of an internal configuration of the earphone cable 200 is illustrated, and in FIG. 3B, an example of an internal configuration of the antenna cable 100 and the connection terminal 310 of the mobile terminal 300 is illustrated.

First, with reference to FIG. 3A, an example of the internal configuration of the earphone cable 200 will be described. The earphone cable 200, as mentioned above, has the plug 203 inserted in the jack 103 of the antenna cable 100. The plug 203 is constituted of a distal end part 210 inserted into the connection terminal 310 of the mobile terminal 300, and a cylindrical rear end part 220 to which the earphone 202L for the Lch and/or the earphone 202R for the Rch are connected.

In the distal end part 210, an Lch terminal 210L, an Rch terminal 210R and a GND terminal 210G are provided in order from a tip end side inserted into the connection terminal 310 of the mobile terminal 300, and each is made to be insulated mutually. In the rear end part 220, a GND terminal 220G, an Rch terminal 220R and an Lch terminal 220L are provided in order from a tip end side, and these are also made to be insulated mutually. The Lch terminal 210L of the distal end part 210 and the Lch terminal 220L of the rear end part 220 are electrically connected inside the rear end part 220, and the Rch terminal 210R of the distal end part 210 and the Rch terminal 220R of the rear end part 220 are electrically connected inside the rear end part 220. The GND terminal 210G of the distal end part 210 and the GND terminal 220G of the rear end part 220 are also electrically connected inside the rear end part 220.

Subsequently, with reference to FIG. 3B, an example of the internal configuration of the antenna cable 100 and the connection terminal 310 of the mobile terminal 300 will be described. In order to facilitate understanding of the description, a configuration of the connection terminal 310 of the mobile terminal 300 is described first, and a configuration example of the antenna cable 100 is described next. In the connection terminal 310 of the mobile terminal 300, provided are a 1pin 311, a 2pin 312, a 3pin 313, a 4pin 314, a 5pin 315 and a shield 316.

The 1pin 311 of the connection terminal 310 functions as a Vbus terminal for power supply when used as a USB cable. However, in a case where the earphone cable 200 to which a microphone is attached is inserted into the antenna cable 100, although not illustrated at this time, the 1pin 311 functions as a MIC terminal in which an audio signal where a signal collected by the microphone is transmitted via the antenna cable 100 is inputted. To a line wired between the 1pin 311 and a connection part of the antenna cable 100, a ferrite bead 317 for high-frequency blocking is connected in series. Note that, even an inductor, when being one which has a capability of carrying out blocking in high frequencies, can be used without problems even when not a ferrite bead. The same way can be carried out also in the other cases. Hereinafter, the ferrite bead is referred to simply as "FB".

The 2pin 312 and 3pin 313 of the connection terminal 310, when used as a USB cable, are terminals of signal lines of a differential signal transmitted and received for communicating with a personal computer, etc. In addition, when an audio signal is inputted into the terminals, the 2pin (D− terminal) 312 is used as a terminal of an L channel, and the 3pin (D+ terminal) 313 is used as a terminal of an R channel. To lines to which the 2pin 312 and 3pin 313 which are used in this differential mode are connected, a common mode choke 318 is connected. By this common mode choke 318 being arranged in this position, a common mode noise is removed when the USB is used, and when the earphone cable 200 and antenna cable 100 are inserted, and an audio signal is transferred, the audio signal comes to be passed to the mobile terminal 300 side. However, at this time, the common mode choke 318 comes to have a high impedance in a high frequency, and functions as a high-frequency blocking element.

The 4pin 314 of the connection terminal 310 is an ID terminal (ID is an abbreviation of Identification, and is referred to as an "identification terminal") for identifying a type of an inserted plug and a usage for which the plug is used. The 4pin 314, when used as a usual USB cable, is usually open. In the present embodiment, the 4pin 314 used as the ID terminal is used as an antenna terminal for receiving television broadcasting, etc. Although details thereof are mentioned later, the shield line 111 which is made to be operated as an antenna element is made to be connected with a line, within the cable part 101, connected to this 4pin 314.

Thereby, via the 4pin 314 used as the antenna terminal, an RF signal received by the shield line 111 becomes able to be taken out. To the line to which the 4pin 314 is connected, a capacitor 319 of approximately 1000 pF has been connected serially, and an RF signal supplied to the 4pin 314 via this capacitor 319 is supplied to a non-illustrated tuner part in the mobile terminal 300.

In addition, an FB320 as a high-frequency signal blocking element is connected to the 4pin 314 of the connection terminal 310 in parallel with the capacitor 319. An RF signal transmitted via the earphone cable 200 and antenna cable 100 is blocked by this FB320, and thereby, only an ID signal transmitted via the cable part 101 is outputted to a non-illustrated ID discrimination circuit in the mobile terminal 300.

The 5pin 315 of the connection terminal 310 is a ground terminal for grounding. A line to which this 5pin 315 is connected is connected with a shield part of an audio plug 102 of the antenna cable 100 and each shield 316 provided in the mobile terminal 300, and is grounded.

Subsequently, with reference to FIG. 3B succeedingly, a configuration example of the antenna cable 100 to which the antenna 10 according to the present disclosure illustrated in FIGS. 1A and 1B is applied will be described. The antenna cable 100, as mentioned above, is configured to have the plug 102 provided in one end of the cable part 101 which is made to have a coaxial structure, and have the jack 103 provided in the other end. A non-illustrated substrate is provided in an end part of the cable part 101 on the side where the plug 102 is provided, and the plug 102 is connected to this substrate.

In the jack 103 of the antenna cable 100, provided are a MIC terminal 103M, an Lch terminal 103L, an Rch terminal 103R, an ID terminal 1031 and a GND terminal 103G. The cable part 101 has a MIC line 101M through which an audio signal inputted from the MIC terminal 103M is transmitted. In addition, the cable part 101 has an Lch line 101L through which an audio signal of the Lch inputted from the Lch terminal 103L is transmitted, and an Rch line 101R through which an audio signal of the Rch inputted from the Rch terminal 103R is transmitted. In addition, the cable part 101 has an ID line 101I connected to the ID terminal 1031, and a GND line 101G connected to the GND terminal 103G.

The MIC line 101M is connected to an FB121 as a high-frequency signal blocking element provided on a non-illustrated substrate, and via this FB121, is connected to the 1pin 311 (Vbus/MIC terminal) in the connection terminal 310 of the mobile terminal 300. The Lch line 101L is connected to an FB122 provided on a non-illustrated substrate, and via this FB122, is connected to the 2pin 312 (D−/Lch terminal) in the connection terminal 310 of the mobile terminal 300. The Rch line 101R is connected to an FB123 provided on a non-illustrated substrate, and via this FB123, is connected to the 3pin 313 in the connection terminal 310 of the mobile terminal 300 (D+/Rch terminal).

The ID line 101I is connected to a resistor 124 provided on a non-illustrated substrate, and via this resistor 124, is connected to the 4pin 314 (ID/antenna terminal) in the connection terminal 310 of the mobile terminal 300. A resistance value of this resistor 124 changes when the earphone cable 200 is connected to the jack 103. By detecting this change of the resistance value, performed is, in the mobile terminal 300 side, processing to carry out switching to not a mode in which the antenna cable 100 is used as a USB cable, but a mode in which the antenna cable 100 is used as a transmission line of an audio signal.

The GND line 101G is connected to an FB125 provided on a non-illustrated substrate, and via this FB125, is connected to the 5pin 315 (GND terminal) in the connection terminal 310 of the mobile terminal 300.

Note that, the FB125 connected to the GND line 101G will have affected an audio signal when a direct-current impedance is high. For example, when the earphone cable 200 is used as a microphone, an echo may be generated when a direct-current impedance of this portion is high. Therefore, the direct-current impedance of the FB125 connected to the GND line 101G is preferred to be made to be 0.25 ohm or less, and is set to approximately 0.1 ohm, for example.

These of the MIC line 101M, the Lch line 101L, the Rch line 101R, the ID line 101I and the GND line 101G which pass inside the cable part 101 of the antenna cable 100 are configured as core wires of the coaxial line. In the outer circumferential part of each of these lines (transmission line), a layer made of a resin 112 is provided as a radio wave absorbing and attenuating part, and the shield line 111 has been trailed on the outside of this layer.

The shield line 111 is one which functions as an antenna element, and receives a broadcast wave of television broadcasting or radio broadcasting. In the present embodiment, the shield line 111 and ID line 101I are connected, and an RF signal received by the shield line 111 is transmitted via the ID line 101I, and is taken out by the 4pin 314 in the connection terminal 310 of the mobile terminal 300.

In the present embodiment, as mentioned above, as a magnetic material which is made to be contained in the resin 112 as the radio wave absorbing and attenuating part, selected is a material in which an imaginary part (μ") which is a magnetic loss term of the complex magnetic permeability is high in a frequency band which is desired to be received by the antenna element. Thereby, since a radio wave transmitted through the antenna element is absorbed and attenuated by the resin 112, it will not occur that the shield line 111 as the antenna element and each transmission line configured as the core wire will have been coupled with each other by capacity coupling. Thereby, since isolation between each transmission line 11 and the antenna element is ensured, reception characteristics of the antenna 10 are also kept satisfactory.

In the present embodiment, as the resin 112, used is one where a ferrite powder having a particle diameter of 1 to 190 μm is mixed with a resin material at a weight ratio of 65 to 90%, and a thickness of the resin 112 is made to be approximately 0.4 mm. Note that, this compounding ratio is appropriate in the case of blocking a frequency of 200 MHz, and the present disclosure is not limited to this value. It is necessary to change a compounding ratio of the ferrite powder with the resin material in accordance with a frequency which is desired to be blocked. In addition, since a ferrite has characteristics where an impedance thereof becomes high in high frequencies, an amount of absorption and attenuation (loss) of a radio wave in low frequencies such as in a FM band is small.

Next, although antenna reception characteristics according to the present embodiment will be described, reception characteristics to be ideal will be considered first. In the following, in a frequency band around 200 MHz which is desired to be made received by a length of a single body of the antenna cable 100, a state where an antenna gain is sufficient is set as a state where the ideal reception characteristics have been acquired.

A length of the antenna cable 100 has been adjusted to a length by which a frequency band in the vicinity of 200 MHz can be received, and actually, by the earphone cable 200 being inserted in the antenna cable 100, antenna characteristics thereof change. For example, when the earphone cable 100 is inserted in the antenna cable 100, the antenna gain deteriorates under the influence of coupling between the shield line 111 and the transmission lines of the audio signal which pass through the inside thereof. In addition, while influenced by the earphone cable 200 inserted into the antenna cable 100, the earphone cable 200 and antenna cable 100 receive as an antenna element the RF signal, and therefore, an antenna length as a whole becomes long, and a frequency band to be received also moves in a direction of a lower frequency band.

Furthermore, when the earphone 202R for the Rch and the earphone 202L for the Lch in the earphone cable 200 are mounted on user's ears, the earphone cable 200 will be arranged at a position close so much to a human body. Thereby, impedance mismatching occurs under the influence of the earphone cable 200 and antenna cable 100 as an antenna element and a human body which is a conductor and dielectric substance, and the antenna gain will have been deteriorated. This antenna gain deterioration becomes remarkable in a vertically polarized wave in particular.

Figure 4:
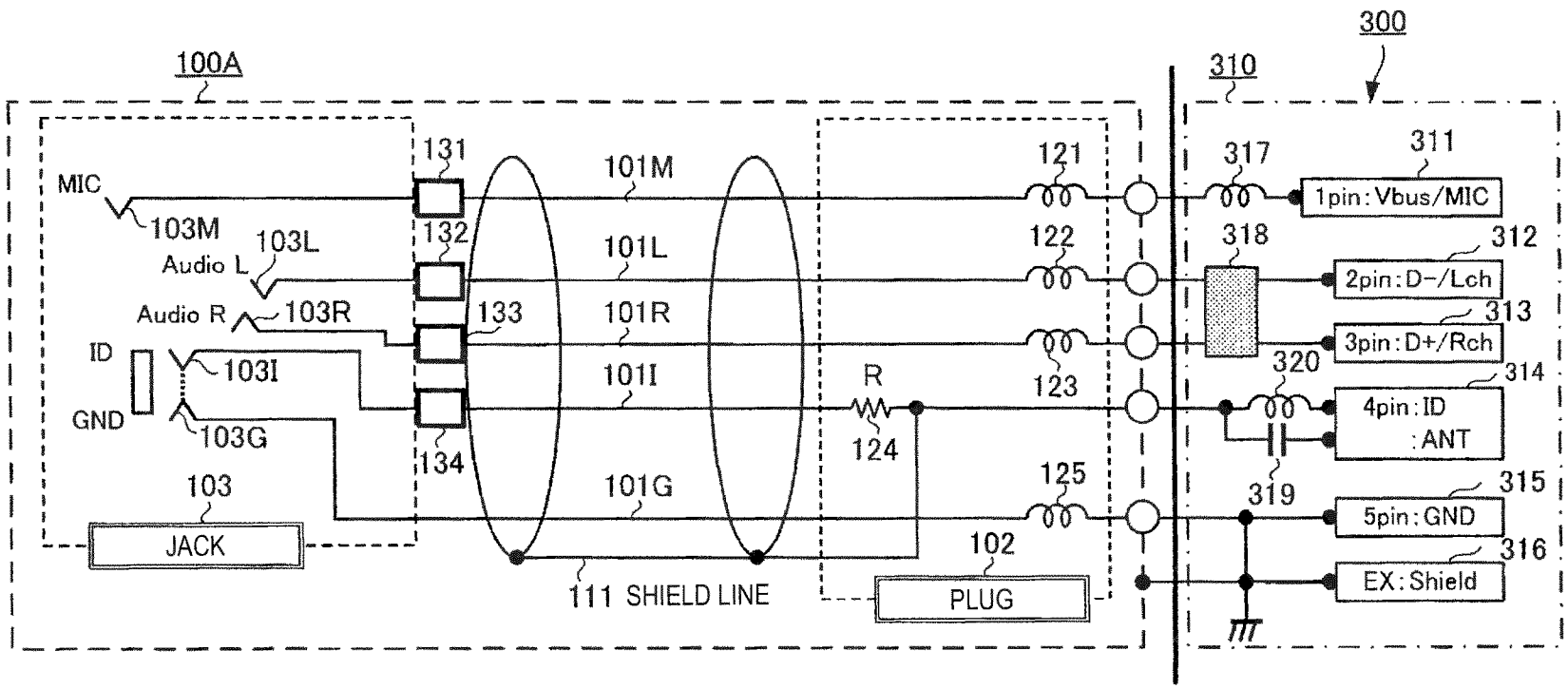
FIG. 4 is a circuit diagram illustrating a configuration example of an antenna cable in a case where a resistor is inserted in a connection section between a cable part and a jack of the antenna cable.

The inventor and others of the present disclosure have considered that these influences can be excluded by a resistor being placed in a connection section between the jack 103 of the antenna cable 100 and the cable part 101. As the result then, it has been turned out that these influences can be excluded perfectly by a resistance value of the resistor being made to be 4.7 kΩ, and reception characteristics which are considered ideal can be acquired. FIG. 4 illustrates a configuration example of an antenna cable 100A for acquiring the ideal antenna reception characteristics, and the same symbol is given to parts corresponding to FIG. 3B. As illustrated in FIG. 4, in the connection sections between the MIC line 101M, Lch line 101L, Rch line 101R, ID line 101I and the jack 103, a resistor 131, resistor 132, resistor 133 and resistor 134 are provided, respectively.

FIGS. 5A to 5F are graphs illustrating antenna reception characteristics by means of the antenna cable 100A illustrated in FIG. 4. FIG. 5A illustrates a graph indicating values measured in a state where the earphone cable 200 is inserted in the jack 103 and is not mounted on a human body (free space), and FIG. 5B indicates measured values in a vertically polarized wave, and FIG. 5C indicates measured values in a horizontally polarized wave. FIG. 5D illustrates a graph indicating values measured in a state where the earphone cable 200 is inserted in the jack 103 and is mounted on a human body, and FIG. 5E indicates measured values in a vertically polarized wave, and FIG. 5F indicates measured values in a horizontally polarized wave.

As illustrated in FIGS. 5A to 5C, in the free space where the earphone cable 200 is not mounted on a human body, a peak gain in the vicinity of 200 MHz indicates a high value of approximately −10 dBd to −13 dBd in both the vertically polarized wave and horizontally polarized wave. On the other hand, a peak gain of the FM band received by the earphone cable 200 being inserted indicates much low values in both the vertically polarized wave and horizontally polarized wave. That is, it is turned out that an influence due to the earphone cable 200 being inserted is excluded and only a frequency in the vicinity of 200 MHz which is desired has been able to be received.

As illustrated in FIGS. 5D to 5F, in a state where the earphone cable 200 is mounted on a human body, a peak gain of the vertically polarized wave in particular in frequencies in the vicinity of 200 MHz has fallen more than measured values in a free space illustrated in FIGS. 5A to 5C. However, the peak gain is −10 dBd approximately in both the vertically polarized wave and horizontally polarized wave, and it can be determined that satisfactory reception characteristics have been acquired.

Figure 6:
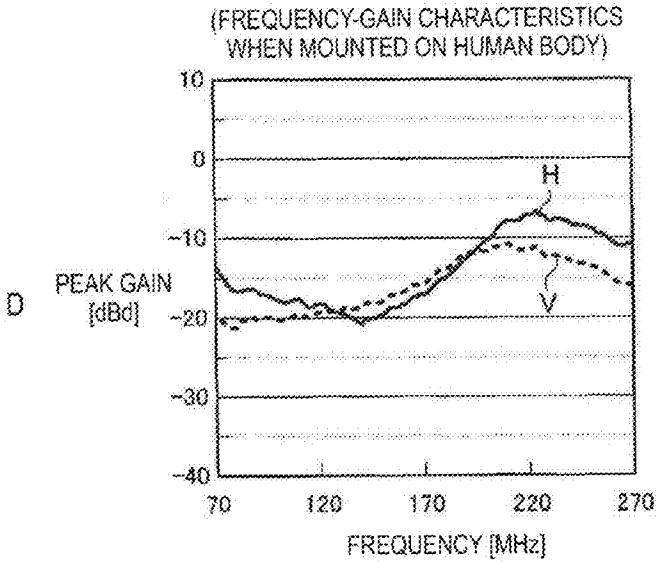
FIG. 6 illustrates frequency-gain characteristics based on a previous antenna cable, in which A to C illustrate frequency-gain characteristics measured in a state where the antenna cable is not mounted on a human body, and D to F illustrate frequency-gain characteristics measured in a state where the antenna cable is mounted on a human body.

FIGS. 6A to 6F illustrate graphs indicating reception characteristics based on a previous antenna cable where the resistor 131 to resistor 134 are not provided. FIG. 6A illustrates a graph indicating values measured in a state where the earphone cable 200 is inserted in the jack 103 and is not mounted on a human body (free space), and FIG. 6B indicates measured values in a vertically polarized wave, and FIG. 6C indicates measured values in a horizontally polarized wave. FIG. 6D illustrates a graph indicating values measured in a state where the earphone cable 200 is inserted in the jack 103 and is mounted on a human body, and FIG. 6E indicates measured values in a vertically polarized wave, and FIG. 6F indicates measured values in a horizontally polarized wave.

As indicated in FIGS. 6A to 6C, in the free space where the earphone cable 200 is not mounted on a human body, it turned out that a high peak gain of approximately −10 dBd has been acquired in both the vertically polarized wave and horizontally polarized wave in a FM band received by the earphone cable 200 being inserted. On the other hand, in the vicinity of 200 MHz of the desired frequency band which is desired to be received, the antenna element of the shield line 111 in the coaxial line functions well in both the vertically polarized wave and horizontally polarized wave, and deterioration thereof remains in a small amount as compared with an ideal state.

As illustrated in FIGS. 6D to 6F, in a state where the earphone cable 200 is mounted on a human body, a peak gain of the vertically polarized wave in particular in frequencies in the vicinity of 200 MHz has fallen more than measured values in a free space illustrated in FIGS. 6A to 6C. In addition, also a peak gain in the FM band has become a low value of −20 dBd approximately in both the vertically polarized wave and horizontally polarized wave.

As mentioned above, as illustrated in FIG. 4, it turned out that by resistors being placed in the connection section between the jack 103 of the antenna cable 100A and the cable part 101, an influence arisen by inserting the earphone cable 200 into the antenna cable 100 can be excluded. However, when the resistors 131 to 134 of 4.7 kΩ are placed in this position, electrical signals such as audio signals will not pass through the lines located ahead of the position where the resistor 131 to resistor 134 are connected. That is, it is hard to be said that it is a realistic solution that a resistance value of a high value as much as 4.7 kΩ is placed in the connection section between the jack 103 of the antenna cable 100A and the cable part 101.

Figure 7:
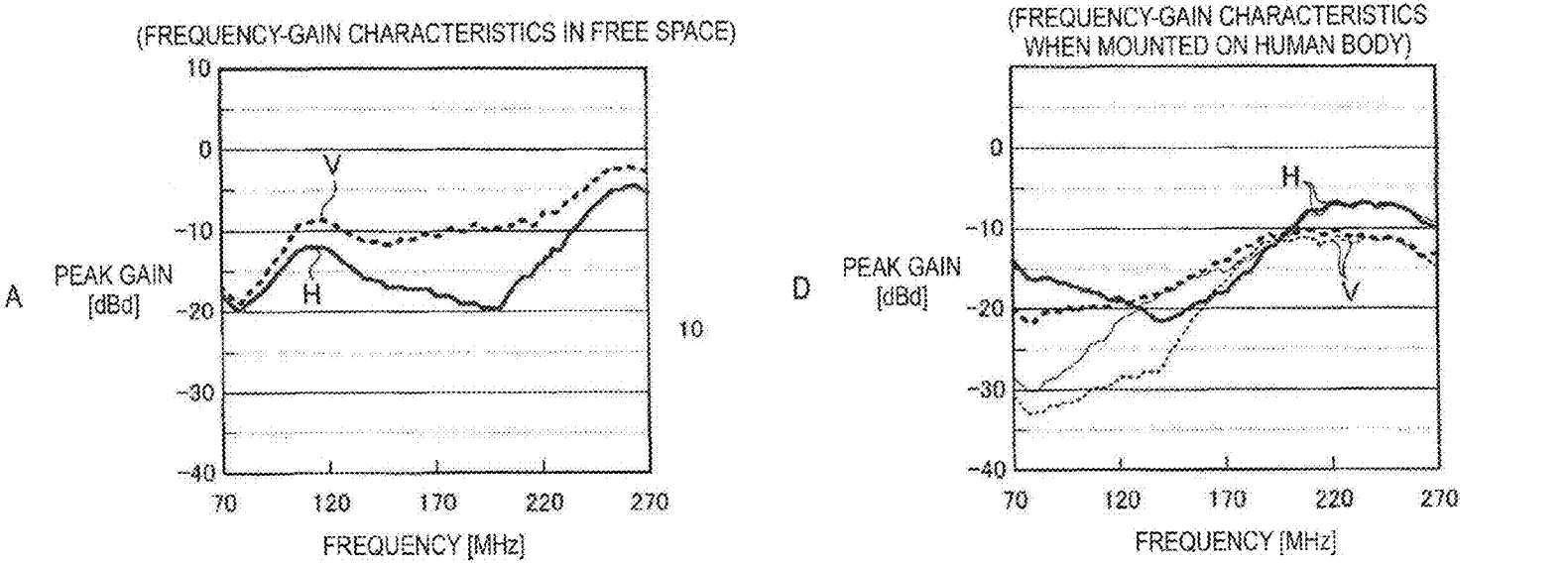
FIG. 7 illustrates frequency-gain characteristics based on an antenna cable according to an embodiment of the present disclosure, in which A to C illustrate frequency-gain characteristics measured in a state where the antenna cable is not mounted on a human body, and D to F illustrate frequency-gain characteristics measured in a state where the antenna cable is mounted on a human body.

FIGS. 7A to 7F are graphs illustrating antenna reception characteristics by means of the antenna cable 100A. FIG. 7A illustrates a graph indicating values measured in a state where the earphone cable 200 is inserted in the jack 103 and is not mounted on a human body (free space), and FIG. 7B indicates measured values in a vertically polarized wave, and FIG. 7C indicates measured values in a horizontally polarized wave. FIG. 7D illustrates a graph indicating values measured in a state where the earphone cable 200 is inserted in the jack 103 and is mounted on a human body, and FIG. 7E indicates measured values in a vertically polarized wave, and FIG. 7F indicates measured values in a horizontally polarized wave. In FIG. 7D, the frequency-gain characteristics of FIG. 5D which have been indicated as ideal reception characteristics are indicated with the same line type and thin line while superimposed.

As illustrated in FIGS. 7A to 7C, in the free space where the earphone cable 200 is not mounted on a human body, although a peak gain in the FM band has fallen a little in both the vertically polarized wave and horizontally polarized wave as compared with characteristics in the previous antenna cable 100 illustrated in FIGS. 6A to 6C, the deterioration remains in a level in which a use carried out without a problem. This is because one which has a small loss in the FM band is selected as a resin of a ferrite. In addition, deterioration in the 200 MHz band remains also in the same level as in the previous level.

As illustrated in FIGS. 7D to 7F, in a state where the earphone cable 200 is mounted on a human body, it turned out that a satisfactory antenna gain of approximately −10 dBd is acquired in the frequency band in the vicinity of 200 MHz in particular. In addition, it turned out that frequency-gain characteristics in the frequency band in the vicinity of 200 MHz are indicated as almost the same shape as the ideal frequency-gain characteristics indicated with a thin line (refer to FIG. 5D).

That is, in accordance with the antenna cable 100 according to the present embodiment example, by providing the layer of the resin 112 containing a magnetic material between various electrical signal transmission lines configured as core wires of the cable part 101 and the shield line 111 which is made to function as the antenna element, the same antenna reception characteristics as in the case where a large resistance value is placed in the connection section of the jack 103 of the cable part 101 can be acquired. That is, by selecting a magnetic material of the resin layer 112 appropriately, deterioration is small in the FM band, and a substantial improvement of antenna characteristics in frequencies of the 200 MHz band which is desired has been realized.

In addition, in accordance with the antenna cable 100 according to the present embodiment example, an influence on an antenna element caused by other wire materials etc. other than the portion which is desired to function as an antenna element can be made small. Thereby, since isolation between the antenna element and other transmission lines is ensured, antenna reception characteristics can be enhanced substantially as compared with a previous configuration.

In addition, in accordance with the antenna cable 100 according to the present embodiment example, by changing a type of a magnetic material which is made to be contained in the resin 112 as the radio wave absorbing and attenuating part and a length of the diameter and a length in a longitudinal direction of the resin 112, etc., a frequency absorption factor and attenuation factor can be adjusted easily.

In addition, in the antenna cable 100 according to the present embodiment example, as illustrated in FIG. 7D etc., a tendency for antenna reception characteristics at the time of horizontally polarized wave reception to be improved is remarkable in particular. Thereby, by being used while connected to the earphone cable 200, etc., even in a case where reception characteristics of the vertically polarized wave become worse due to an influence of a human body, the radio wave of the desired frequency will be able to be received by the horizontally polarized wave side in which a high antenna gain is acquired.

In addition, in accordance with the antenna cable 100 according to the present embodiment example, between electrical signal transmission lines and the shield line 111 which is made to function as an antenna element, the resin 112 as the radio wave absorbing and attenuating part is provided. Therefore, it also becomes possible to adopt a configuration in which a volume ratio of the resin 112 with respect to a volume of electrical signal transmission lines is made to be significantly large. When configured in this way, a portion of the inner diameter part of the layer formed by the resin 112, which comes in contact with electrical signal transmission lines, comes to have a high impedance, and a portion which comes in contact with the shield line 111 of the outer diameter part comes to have a low impedance. That is, while isolation from electrical signal transmission lines is ensured, it is also possible to make antenna reception characteristics enhanced more.

<3. Various Modification Examples>

Note that, by providing a layer of the resin 112 containing a magnetic material between core wires and the shield line 111, isolation between various electrical signal transmission lines and an antenna element will be able to be ensured, and therefore, it becomes also possible to reduce the number of high-frequency signal blocking elements.

Figure 8:
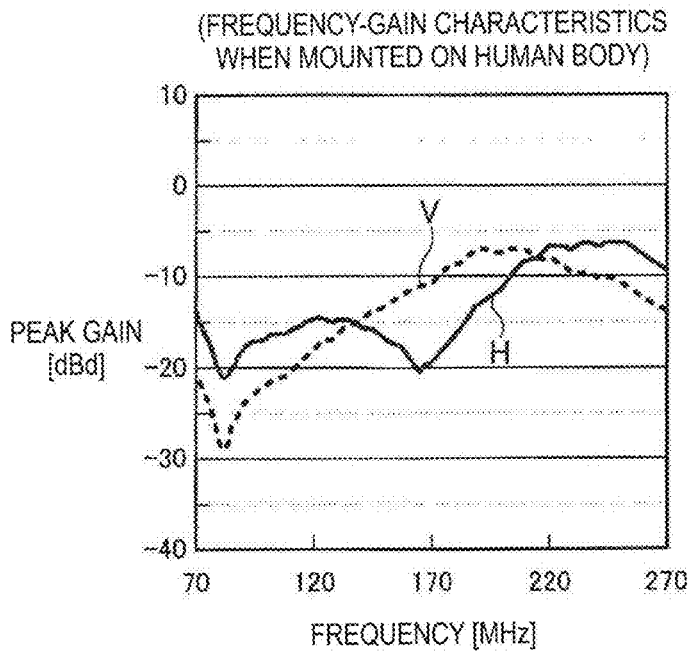
FIG. 8 illustrates frequency-gain characteristics based on a configuration in which an FB125 inserted in a GND line 101G is removed, according to an embodiment of the present disclosure.

FIGS. 8A to 8C illustrate frequency-gain characteristics based on a configuration in which the FB125 inserted in the GND line 101G has been removed from the configuration of the antenna cable 100 according to the present embodiment illustrated in FIGS. 3A and 3B. The frequency-gain characteristics illustrated in FIGS. 8A to 8C are measured in a state where the earphone cable 200 mounted on the antenna cable 100 is mounted on a human body. FIG. 8A illustrates frequency-gain characteristics indicated with a graph, and FIG. 8 illustrates a measured value in the vertically polarized wave, and FIG. 8C illustrates a measured value in the horizontally polarized wave.

It turned out that a peak gain in the vicinity of 200 MHz which is a target frequency band desired to be received is approximately −7 dBd in the vertically polarized wave and approximately −10 dBd in the horizontally polarized wave, and is almost equivalent to the characteristics illustrated both in FIG. 7D at the time of the FB 125 being inserted. That is, it turned out that even when the FB 125 for high-frequency signal blocking is not used, the influence has been able to be eliminated while an RF signal is blocked.

As mentioned above, a direct-current impedance has been required to be low for the FB125 inserted in the GND line 101G, and when an element which has a high impedance in a high frequency while fulfilling this condition is intended to be selected, there is a problem that an element size will have been enlarged. By a high frequency signal being able to be blocked without using such FB125, circuit size reduction and cost reduction can be promoted.

Note that, by using the antenna cable 100 of the present disclosure, the same effects as effects acquired by the present embodiment are acquired even when the FB121 to FB123 which are inserted in the other transmission lines in the cable part 101 are eliminated.

In addition, in the above mentioned embodiment, although a case where a length of the antenna cable 100 is 300 mm has been given as an example, it is not limited to this. As for a length of the antenna cable 100, various lengths in accordance with a wavelength of a frequency which is desired to be received are applicable. Furthermore, although a case where a length of the earphone cable 200 inserted in the antenna cable 100 is 500 mm has been given as an example, a length of the earphone cable 200 is not limited to this value, either.

FIGS. 9A to 9F illustrate graphs indicating frequency-gain characteristics of an antenna which are measured in a state where the earphone cable 200 having a length of 1100 mm is inserted and in a free space where the earphone cable 200 is not mounted on a human body. FIGS. 9A to 9C indicate characteristics based on the previous antenna cable, and FIGS. 9D to 9F indicate characteristics based on the antenna cable 100 according to the present embodiment. FIGS. 9A and 9D indicate frequency-gain characteristics with graphs, and FIGS. 9B and 9E indicate measured values in the vertically polarized wave, and FIGS. 9C and 9F indicate measured values in the horizontally polarized wave.

In accordance with characteristics based on the previous antenna cable illustrated in FIGS. 9A to 9C, a peak gain of approximately −13.5 dBd to approximately −2.5 dBd is acquired in the vertically polarized wave in a frequency band after 200 MHz which is enclosed with a dashed line circle in FIG. 9A. In the horizontally polarized wave, a peak gain of approximately −20 dBd to approximately −7.5 dBd is acquired. As compared with this, in accordance with characteristics of the antenna cable 100 according to the present embodiment illustrated in FIGS. 9D to 9F, a peak gain of approximately −12 dBd to approximately −2.5 dBd is acquired in the vertically polarized wave. In the horizontally polarized wave, a peak gain of approximately −15 dBd to approximately −6 dBd is acquired. That is, as compared with the previous antenna cable, it turned out that antenna reception characteristics have been improved.

FIGS. 10A to 10F illustrate graphs indicating frequency-gain characteristics of an antenna which are measured in a state where the earphone cable 200 having a length of 1100 mm is inserted and the earphone cable 200 is mounted on a human body. FIGS. 10A to 10C indicate characteristics based on the previous antenna cable, and FIGS. 10D to 10F indicate characteristics based on the antenna cable 100 according to the present embodiment. FIGS. 10A and 10D indicate frequency-gain characteristics with graphs, and FIGS. 10B and 10E indicate measured values in the vertically polarized wave, and FIGS. 10C and 10F indicate measured values in the horizontally polarized wave.

In accordance with characteristics based on the previous antenna cable illustrated in FIGS. 10A to 10C, a peak gain of approximately −13 dBd to approximately −9 dBd is acquired in the vertically polarized wave in a frequency band after 200 MHz which is enclosed with a dashed line circle in FIG. 10A. In the horizontally polarized wave, a peak gain of approximately −15.5 dBd to approximately −6 dBd is acquired. As compared with this, in accordance with characteristics of the antenna cable 100 according to the present embodiment illustrated in FIGS. 10D to 10F, a peak gain of approximately −12 dBd to approximately −7.5 dBd is acquired in the vertically polarized wave. In the horizontally polarized wave, a peak gain of approximately −14 dBd to approximately −5 dBd is acquired. That is, as compared with the previous antenna cable, it turned out that antenna reception characteristics have been greatly improved especially in the horizontally polarized wave.

In addition, in the above mentioned embodiment, although a case where the number of electrical signal transmission lines is five (MIC, Lch, Rch, ID and GND) is given as an example, configuring thereof may be carried out as three lines like the configuration illustrated as a principle figure in FIGS. 1A and 1B, or may be carried out as other number of lines.

In addition, in the above mentioned embodiment, although an example where various transmission lines configured as core wires are covered directly with the resin 112 as the radio wave absorbing and attenuating part has been given, an example is not limited to this. In order to facilitate fixing of arrangement positions of various transmission lines, each transmission line may be fixed first while being covered by a resin such as a polyethylene, and the resin 112 may be provided in the outer circumferential part.

[Modification Example 1]

Figure 11:
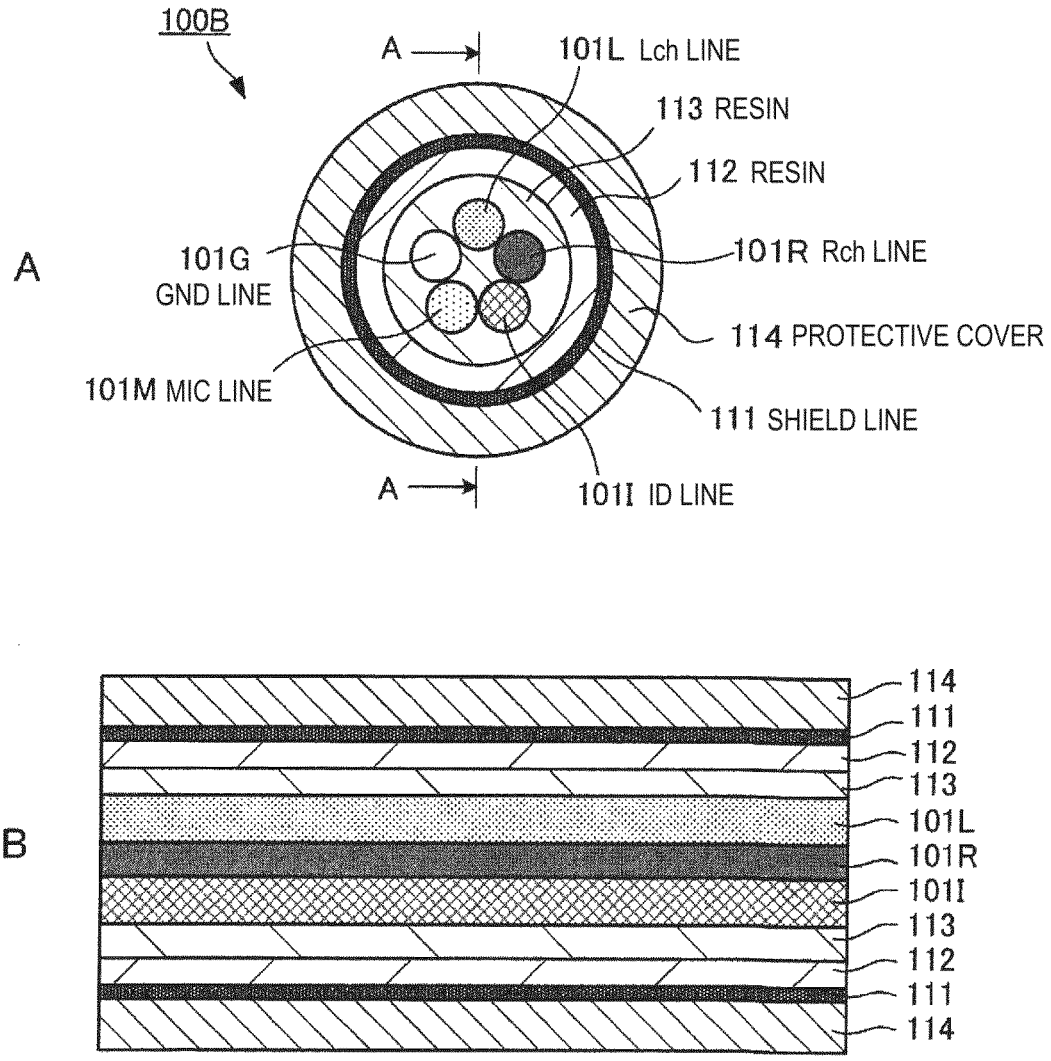
FIG. 11 is schematic diagrams illustrating an example of a schematic configuration of an antenna cable according to a modification example 1 of the present disclosure, in which A illustrates a sectional view in a case of being cut in a diameter direction, and B illustrates a sectional view in a case of being cut in a line length direction.

FIGS. 11A and 11B illustrate sectional views indicating a schematic configuration of a cable part 101B of an antenna cable 100B in the case of being configured in this way. FIG. 11A is a sectional view in a case where the cable part 101B is cut in a direction perpendicular to a line length direction, and FIG. 11B is a sectional view in a case where the cable part 101B is cut in a line length direction, and viewed from a direction indicated as a cross section indicating line A illustrated in FIG. 11A.

As illustrated in FIGS. 11A and 11B, wiring positions of the Lch line 101L, Rch line 101R, ID line 101I, MIC line 101M and GND line 101G in a central part of the cable part 101B are made to be covered with a resin 113 such as a polyethylene. Then, an outer circumferential part thereof has been covered with the resin 112 including the magnetic material as the radio wave absorbing and attenuating part. The external configuration thereof is the same as the configuration according to an above mentioned embodiment, and the shield line 111 as the antenna element is trailed, and the outer circumferential part thereof is covered with the protective cover 114.

In addition, in the above mentioned embodiment, although an example where electrical signal transmission lines and the shield line 111 as the antenna element are provided in different layers within one cable having a coaxial structure, and a layer of the resin 112 including the magnetic material is provided between these has been described, an example is not limited to this. For example, application to one where a line in which electrical signal transmission lines are configured while covered by a resin and a line with an antenna line covered by a resin are made to be arranged in parallel, and these are made to be configured integrally as a cable, etc. is possible.

[Modification Example 2]

FIGS. 12A and 12B illustrate a configuration of a cable part 101Bα in which a single side aluminum foil tape 115 is provided between the resin 112 in the configuration of the cable part 101B illustrated in FIGS. 11A and 11B and the shield line 111. FIG. 12A is a sectional view in a case where the cable part 101Bα is cut in a direction perpendicular to a line length direction, and FIG. 12B is a sectional view in a case where the cable part 101Bα is cut in a line length direction, and viewed from a direction indicated as a cross section indicating line A illustrated in FIG. 12A. In FIGS. 12A and 12B, the same symbol is given to parts corresponding to FIGS. 11A and 11B, and overlapped descriptions are omitted.

The single side aluminum foil tape 115 illustrated in FIGS. 12A and 12B has one side made of an aluminum foil, and the other side made of an electric insulation adhesive tape. In the configuration illustrated in FIGS. 12A and 12B, the aluminum foil is arranged on the resin 112 side, and the electric insulation adhesive tape is arranged on the shield line 111 side. By the single side aluminum foil tape 115 as configured in this way being provided between the resin 112 and the shield line 111, noises generated from each transmission line provided in the center of the cable part 101B will be blocked more surely by the aluminum foil of the single side aluminum foil tape 115. That is, noises generated from each transmission line will become more difficult to leak into the shield line 111 side as the antenna element.

In addition, according to the configuration illustrated in FIGS. 12A and 12B, the shield line 111 and resin 112 are adhered closely by the single side aluminum foil tape 115 having the electric insulation adhesive tape. That is, a discontinuous space becomes difficult to be generated in an interface surface between a conductor made of the shield line 111 and aluminum foil and a magnetic body made of the resin 112 containing a magnetic material. Therefore, in a portion of a boundary between the shield line 111 and aluminum foil as a conductor and the resin 112 as a magnetic body, noises generated from each transmission line becomes difficult to jump out to the outside. Therefore, according to the configuration illustrated in FIGS. 12A and 12B, a function as the radio wave absorbing and attenuating part of the resin 112 can be enhanced further.

Note that, in an example illustrated in FIGS. 12A and 12B, although an example where adhering is carried out between the shield line 111 and the resin 112 with the single side aluminum foil tape 115 has been given, an example is not limited to this. In place of the single side aluminum foil tape 115, an aluminum foil without an electric insulation adhesive tape may be provided. Note that, since a portion of this aluminum foil may be any of conductors, other members such as copper and gold may be used.

[Modification Example 3]

Figure 13:
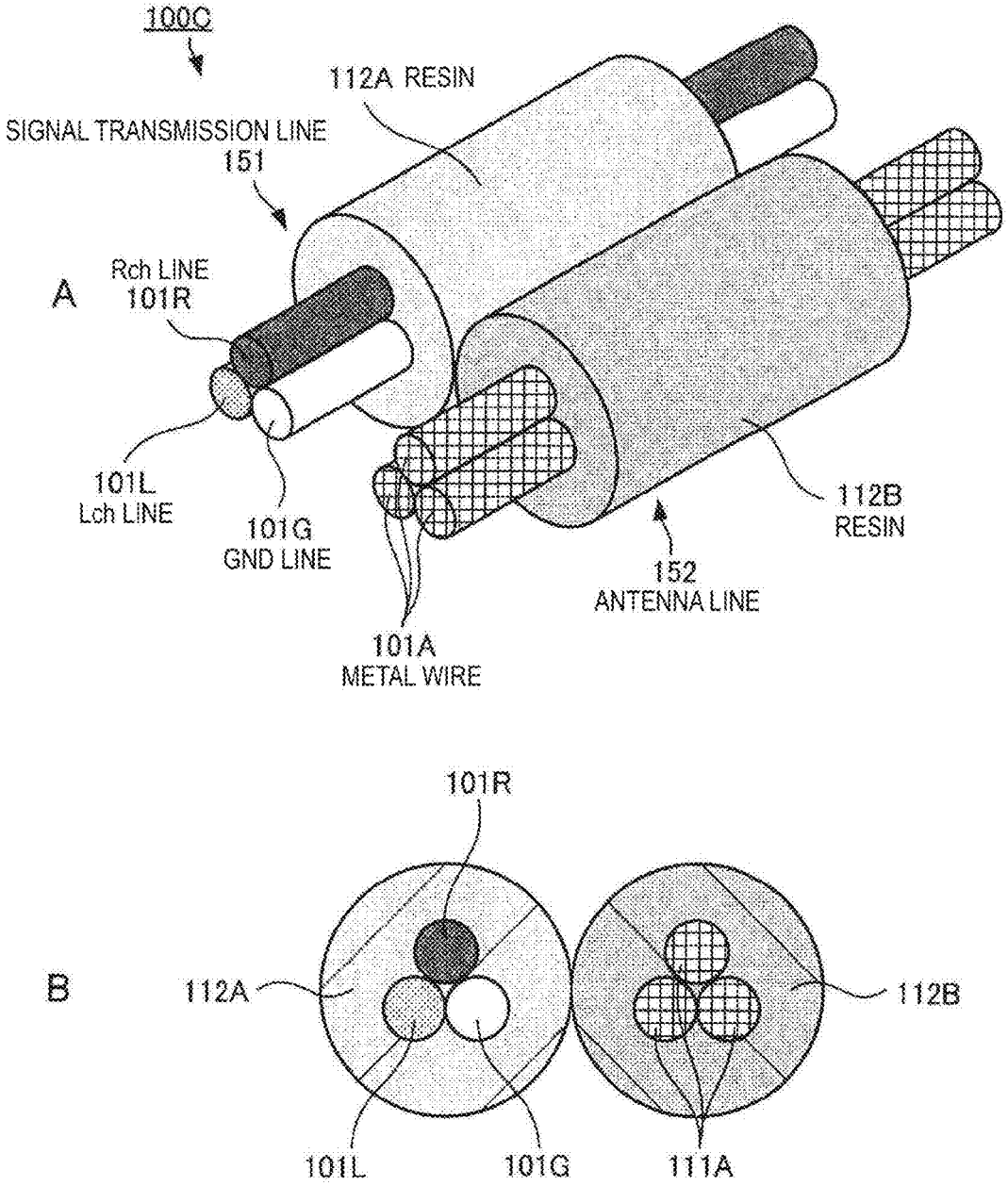
FIG. 13 is schematic diagrams illustrating an example of a schematic configuration of an antenna cable according to a modification example 3 of the present disclosure, in which A illustrates a perspective view, and B illustrates a sectional view in the case of being cut in a diameter direction.

FIGS. 13A and 13B are schematic diagrams illustrating a schematic configuration of a cable part 101C of an antenna cable 100C in the case of being configured in this way. FIG. 13A is a perspective view, and FIG. 13B is a sectional view when the cable is cut in a direction perpendicular to the line length direction. The antenna cable 100C illustrated in FIGS. 13A and 13B is configured so that a signal transmission line 151 and an antenna line 152 are arranged in parallel mutually, and are covered with a non-illustrated protective cover. The signal transmission line 151 has an Lch line 101LC, an Rch line 101RC and the GND line 101G covered with a resin 112A, and the antenna line 152 is configured to have two or more metal wires 111A which are made of annealed copper wires, etc. covered with a resin 112B. The resin 112A and resin 112B are ones which contain each the magnetic material as mentioned above, and function as the radio wave absorbing and attenuating part.

As mentioned above, the signal transmission line 151 which transmits an audio signal and other electrical signals and the antenna line 152 as the antenna element may be covered individually with the resin 112A or resin 112B, respectively, and these may be configured integrally as a cable. The signal transmission line 151 and antenna line 152 at this time may be configured each as a single cable, or may be configured as two or more cables as illustrated in FIGS. 13A and 13B. In addition, as illustrated in FIGS. 11A and 11B, the resin 112A or resin 112B containing a magnetic material may be provided on the outer circumference thereof after wire materials are once covered by a resin such as a polyethylene. In addition, the resin 112A and 112B may be made of a resin such as a polyethylene, and either one of them may contain a magnetic material.

In addition, in the above mentioned embodiment, although an example where the antenna element is constituted as the shield line 111 of a braided structure and an example where the antenna element is constituted as the metal wire 101A arranged in parallel to the signal transmission line 151 have been given, an example is not limited to these configurations. For example, an antenna element may be constituted by winding spirally a metal wire made of a metal wire such as an annealed copper wire on the outer circumference of a cylindrical resin covering signal transmission lines.

[Modification Example 4]

Figure 14:
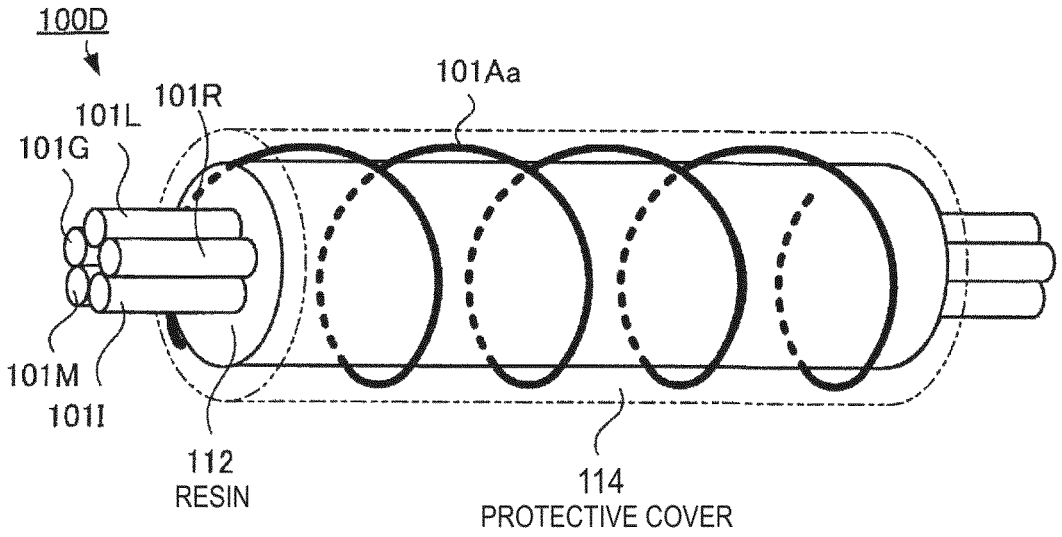
FIG. 14 is a schematic diagram illustrating an example of a schematic configuration of an antenna cable according to a modification example 4 of the present disclosure.

FIG. 14 is a schematic diagram illustrating an example of a schematic configuration of an antenna cable 100D where the antenna element is constituted in this way. Transmission lines which transmit an electrical signal are configured as core wires of a cable having a coaxial structure in the same way as an above mentioned embodiment, and include the Lch line 101L, Rch line 101R, ID line 101I, MIC line 101M and GND line 101G, for example. The outer circumferential part of these signal transmission lines has been covered with the resin 112 as the radio wave absorbing and attenuating part containing the magnetic material, and on the outer circumferential part, a metal wire 101Aa such as an annealed copper wire has been wound spirally.

By carrying out constitution in this way, the metal wire 101Aa longer than a cable length of the antenna cable 100 becomes possible to be housed in the antenna cable 100. Thereby, without making a cable length of the antenna cable 100 long, a frequency band lower than a frequency band which can be received with a cable length of the antenna cable 100 becomes possible to be received by the metal wire 101Aa wound around the antenna cable 100. Therefore, it becomes possible to promote miniaturization of a device. Thereby, an application to a product having a large restriction on a length of a cable part, such as an earphone integrated sound reproduction device etc. in which a sound reproduction function and a tuner part are made to be built-in in the earphone portion will become possible, for example.

Additionally, the present technology may also be configured as below.

(1) An antenna including:

an antenna element that has a prescribed length;

a transmission line that transmits an electrical signal; and a radio wave absorbing and attenuating part that has characteristics to absorb and attenuate a radio wave of a frequency band received by the antenna element and is arranged at least between the antenna element and the transmission line.

(2) The antenna according to (1), wherein the radio wave absorbing and attenuating part is formed with an insulator containing a magnetic material.

(3) The antenna according to (1) or (2), wherein a material whose value of imaginary part μ" of a magnetic loss term of a complex magnetic permeability is large in a frequency band which the antenna element receives is used for the magnetic material contained in the insulator.

(4) The antenna according to any one of (1) to (3), further including:

a covering part that covers the antenna element, the transmission line and the radio wave absorbing and attenuating part, wherein the antenna is configured as a cable in which the antenna element, the transmission line, the radio wave absorbing, and attenuating part and the covering part are integrated.

(5) The antenna according to any one of (1) to (4), wherein the transmission line is covered with the radio wave absorbing and attenuating part in an approximately full length of the transmission line, and wherein the antenna element is arranged outside the radio wave absorbing and attenuating part.

(6) The antenna according to (4) or (5), wherein the antenna element is provided in a shape which covers an approximately full length of the radio wave absorbing and attenuating part on an outer circumferential part of the radio wave absorbing and attenuating part.

(7) The antenna according to any one of (4) to (6), wherein the antenna element is formed as a braided wire or a winding wire on an outer circumferential part of the radio wave absorbing and attenuating part.

(8) The antenna according to any one of (4) to (7), wherein the antenna element has a linear shape, and is constituted while spirally wound around an outer circumferential part of the radio wave absorbing and attenuating part.

(9) The antenna according to any one of (1) to (5), wherein the antenna is configured in a manner that the transmission line that is covered with the radio wave absorbing and attenuating part in an approximately full length of the transmission line and the antenna element that is covered with the radio wave absorbing and attenuating part in the approximately full length of the outer circumferential part of the antenna element are arranged in parallel inside the covering part.

(10) The antenna according to any one of (1) to (9), wherein the magnetic material contained in the insulator which forms the radio wave absorbing and attenuating part is a ferrite.

REFERENCE SIGNS LIST

1 receiving system
10 antenna
11 transmission line
11G GND line
11L Lch line
11R Rch line
12 resin
13 shield line
14 protective cover
100, 100A, 100B, 100C, 100D antenna cable
101 cable part
101A, 101Aa, 101Ab metal wire
101B, 101C cable part
101G GND line
101I ID line
101L Lch line
101LC Lch line
101M MIC line
101R Rch line
101RC Rch line
102 plug
103 jack
103G GND terminal
1031 ID terminal
103L Lch terminal
103M MIC terminal
103R Rch terminal
111 shield line
112, 112A, 112B, 113 resin
114 protective cover
115 single side aluminum foil tape
124, 131 to 134 resistor
151 signal transmission line
152 antenna line
200 earphone cable
201 cable part
202L earphone for Lch
202R earphone for Rch
203 plug
210 distal end part
210G GND terminal
210L Lch terminal
210R Rch terminal
220 rear end part
220G GND terminal
220L Lch terminal
220R Rch terminal
300 mobile terminal
310 connection terminal
311 1pin
312 2pin
313 3pin
314 4pin
315 5pin
316 shield

317 ferrite bead
318 common mode choke
319 capacitor
320 display part

The invention claimed is:

1. An antenna comprising:

an antenna element that has a prescribed length;

a transmission line that transmits an electrical signal; and a radio wave absorbing and attenuating part that has characteristics to absorb and attenuate a radio wave of a frequency band received by the antenna element and is arranged at least between the antenna element and the transmission line, wherein the radio wave absorbing and attenuating part is formed with an insulator containing a magnetic material;

a material whose value of imaginary part μ" of a magnetic loss term of a complex magnetic permeability is large in a frequency band which the antenna element receives is used for the magnetic material contained in the insulator, and a covering part that covers the antenna element, the transmission line and the radio waive absorbing and attenuating part, wherein the antenna is configured as a cable in which the antenna element, the transmission line, the radio wave absorbing, and attenuating part and the covering part are integrated.

2. The antenna according to claim 1, wherein the transmission line is covered with the radio wave absorbing and attenuating part in an approximately full length of the transmission line, and wherein the antenna element is arranged outside the radio wave absorbing and attenuating part.

3. The antenna according to claim 2, wherein the antenna element is provided in a shape which covers an approximately full length of the radio wave absorbing and attenuating part on an outer circumferential part of the radio wave absorbing and attenuating part.

4. The antenna according to claim 3, wherein the antenna element is formed as a braided wire or a winding wire on an outer circumferential part of the radio wave absorbing and attenuating part.

5. The antenna according to claim 3, wherein the antenna element has a linear shape, and is constituted while spirally wound around an outer circumferential part of the radio wave absorbing and attenuating part.

6. The antenna according to claim 2, wherein the antenna is configured in a manner that the transmission line that is covered with the radio wave absorbing and attenuating part in an approximately full length of the transmission line and the antenna element that is covered with the radio wave absorbing and attenuating part in the approximately full length of the outer circumferential part of the antenna element are arranged in parallel inside the covering part.

7. The antenna according to claim 1, wherein the magnetic material contained in the insulator which forms the radio wave absorbing and attenuating part is a ferrite.

* * * * *